US011180344B2

(12) United States Patent
Quaretti et al.

(10) Patent No.: US 11,180,344 B2
(45) Date of Patent: Nov. 23, 2021

(54) ELEVATOR DOORWAY DISPLAY SYSTEMS FOR ELEVATOR CARS

(71) Applicant: Otis Elevator Company, Farmington, CT (US)

(72) Inventors: Bruno Quaretti, Nevoy (FR); Eric Vaunois, Briare (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 869 days.

(21) Appl. No.: 15/974,995

(22) Filed: May 9, 2018

(65) Prior Publication Data

US 2018/0339879 A1 Nov. 29, 2018

(30) Foreign Application Priority Data

May 23, 2017 (EP) ..... 17305607

(51) Int. Cl.

| | |
|---|---|
| ***B66B 3/00*** | (2006.01) |
| ***B66B 3/02*** | (2006.01) |
| ***B66B 11/02*** | (2006.01) |
| ***B66B 5/00*** | (2006.01) |

(52) U.S. Cl.

CPC ..... *B66B 3/023* (2013.01); *B66B 3/008* (2013.01); *B66B 5/0012* (2013.01); *B66B 5/0018* (2013.01); *B66B 11/0246* (2013.01)

(58) Field of Classification Search

CPC ..... B66B 3/00; B66B 3/008; B66B 5/0012; B66B 11/0226; B66B 3/002; B66B 1/3492; B66B 5/0018; B66B 5/0006

See application file for complete search history.

(56) References Cited

U.S. PATENT DOCUMENTS

| | | | |
|---|---|---|---|
| 5,131,508 | A | 7/1992 | Suzuki |
| 5,485,897 | A | 1/1996 | Matsumoto et al. |

(Continued)

FOREIGN PATENT DOCUMENTS

| | | | |
|---|---|---|---|
| CN | 102556787 | A | 7/2012 |
| CN | 203383675 | U | 1/2014 |

(Continued)

OTHER PUBLICATIONS

European Search Report, European Application No. 17305607.8, dated Jan. 8, 2018, European Patent Office; European Search Report 8 pages.

*Primary Examiner* — Marlon T Fletcher

(74) *Attorney, Agent, or Firm* — Cantor Colburn LLP

(57) ABSTRACT

Elevator systems including an elevator car having a first elevator car door and an openable ceiling, the openable ceiling comprising a ceiling frame and an openable panel, the openable panel moveable from an open position to a closed position relative to the ceiling frame, an imaging device mounted to the openable panel and configured to capture image data of a detection zone that includes at least an opening formed by the first elevator car door when the openable panel is in the closed position, and a display located within the elevator car to display an image associated with the image data received from the imaging device. The openable panel is openable to create an access way that permits access from an interior of the elevator car to a top exterior of the elevator car.

20 Claims, 7 Drawing Sheets

(56) References Cited

U.S. PATENT DOCUMENTS

| | | | | |
|---|---|---|---|---|
| 6,161,654 | A * | 12/2000 | Sirigu | B66B 3/00 187/391 |
| 6,341,668 | B1 | 1/2002 | Fayette et al. | |
| 6,386,325 | B1 * | 5/2002 | Fujita | B66B 1/3476 187/316 |
| 9,481,548 | B2 * | 11/2016 | Siddiqui | B66B 1/3476 |
| 2002/0057279 | A1 * | 5/2002 | Jouppi | G09G 5/00 345/619 |
| 2004/0045339 | A1 | 3/2004 | Nichani et al. | |
| 2005/0249382 | A1 | 11/2005 | Schwab et al. | |
| 2006/0037818 | A1 * | 2/2006 | Deplazes | G08B 13/1961 187/392 |
| 2006/0289244 | A1 | 12/2006 | Sittler | |
| 2015/0147626 | A1 * | 5/2015 | Tajima | H01M 10/0463 429/139 |
| 2016/0343187 | A1 * | 11/2016 | Trani | H01Q 1/243 |
| 2017/0029245 | A1 | 2/2017 | Olthuis et al. | |
| 2017/0171719 | A1 * | 6/2017 | Igarashi | H04W 4/33 |
| 2018/0086595 | A1 * | 3/2018 | Guillot | B66B 3/00 |
| 2018/0339879 | A1 * | 11/2018 | Quaretti | B66B 3/023 |
| 2019/0359449 | A1 * | 11/2019 | Schmidt | B66B 3/008 |
| 2020/0031619 | A1 * | 1/2020 | Sudi | B66B 13/26 |
| 2020/0324662 | A1 * | 10/2020 | Vain | G05D 1/0225 |
| 2021/0206598 | A1 * | 7/2021 | Roth | B66B 1/468 |

FOREIGN PATENT DOCUMENTS

| | | | |
|---|---|---|---|
| CN | 103964271 | A | 8/2014 |
| CN | 204280986 | U | 4/2015 |
| CN | 205328417 | U | 6/2016 |
| CN | 106167216 | A | 11/2016 |
| CN | 205906852 | U | 1/2017 |
| EP | 1345445 | A1 | 9/2003 |
| EP | 1577247 | A1 | 9/2005 |
| EP | 1574468 | B1 | 11/2006 |
| EP | 2295361 | A1 | 3/2011 |
| EP | 3076247 | A1 | 5/2016 |
| GB | 2243906 | A | 3/1991 |
| JP | 10077178 | A | 3/1998 |
| JP | 2000219448 | | 8/2000 |
| JP | 2003081544 | A | 3/2003 |
| JP | 2004338858 | A | 12/2004 |
| JP | 2007219865 | A | 2/2006 |
| JP | 2006137589 | A | 6/2006 |
| JP | 2007031105 | A | 2/2007 |
| JP | 2008074535 | A | 4/2008 |
| JP | 2014034469 | A | 2/2014 |
| JP | 2014210629 | A | 11/2014 |
| JP | 2014227299 | A | 12/2014 |
| KR | 20140059962 | A | 5/2014 |
| WO | 2006048497 | A1 | 5/2006 |

* cited by examiner

ELEVATOR DOORWAY DISPLAY SYSTEMS FOR ELEVATOR CARS

CROSS-REFERENCE TO RELATED APPLICATIONS

This application claims the benefit of European Application No. 17305607.8, filed May 23, 2017, which is incorporated herein by reference in its entirety.

BACKGROUND

The subject matter disclosed herein generally relates to elevator cars and, more particularly, elevator car rear-view camera systems.

Entering and exiting elevator cars can be difficult for persons with disabilities, such as being wheelchair bound, or for persons carrying large objects. Such persons may enter an elevator car facing toward a far wall, and once entered cannot turn around to face the elevator car doors. Thus, when the elevator car doors open at a landing (e.g., the passenger's destination floor), the passenger may not be able to tell if a person or object is on the landing and blocking their exit from the elevator car. Accordingly, one solution has been to provide mirrors located in upper corners of elevator cars to allow such passengers to determine if something or someone is blocking exit from the elevator car. It may be advantageous to provide improved mechanisms for such passengers to obtain the information they require for exiting an elevator car.

SUMMARY

According to some embodiments, elevator systems are provided. The elevator systems include an elevator car having a first elevator car door and an openable ceiling, the openable ceiling comprising a ceiling frame and an openable panel, the openable panel moveable from an open position to a closed position relative to the ceiling frame, an imaging device mounted to the openable panel and configured to capture image data of a detection zone that includes at least an opening formed by the first elevator car door when the openable panel is in the closed position, and a display located within the elevator car to display an image associated with the image data received from the imaging device. The openable panel is openable to create an access way that permits access from an interior of the elevator car to a top exterior of the elevator car.

In addition to one or more of the features described herein, or as an alternative, further embodiments of the elevator systems may include that the imaging device is operably connected to the display by wiring.

In addition to one or more of the features described herein, or as an alternative, further embodiments of the elevator systems may include that the wiring is housed within a flexible cable that enables movement of the imaging device when the openable panel is moved from the closed position to the open position.

In addition to one or more of the features described herein, or as an alternative, further embodiments of the elevator systems may include that the openable ceiling further comprises a pivot mechanism, the openable panel pivotable about the pivot mechanism relative to the ceiling frame.

In addition to one or more of the features described herein, or as an alternative, further embodiments of the elevator systems may include that the pivot mechanism is arranged internally to a portion of the openable panel.

In addition to one or more of the features described herein, or as an alternative, further embodiments of the elevator systems may include that the openable panel includes a handle.

In addition to one or more of the features described herein, or as an alternative, further embodiments of the elevator systems may include that the handle includes a latching mechanism arranged to releasably secure the openable panel in the closed position.

In addition to one or more of the features described herein, or as an alternative, further embodiments of the elevator systems may include that the openable panel includes a viewing aperture that is sized and shaped to allow a detection zone to be viewed by the imaging device.

In addition to one or more of the features described herein, or as an alternative, further embodiments of the elevator systems may include that the elevator car includes a second elevator car door and the detection zone includes at least an opening formed by the second elevator car door when the openable panel is in the closed position.

In addition to one or more of the features described herein, or as an alternative, further embodiments of the elevator systems may include that the imaging device is a mounted camera that extends from the openable panel.

In addition to one or more of the features described herein, or as an alternative, further embodiments of the elevator systems may include that the image data is live video image of the detection zone.

In addition to one or more of the features described herein, or as an alternative, further embodiments of the elevator systems may include that the image data is captured only when the elevator car door is open.

In addition to one or more of the features described herein, or as an alternative, further embodiments of the elevator systems may include that the displayed image associated with the image data comprises one of a live video, a still image, a notification, a cartoon, or an indicator that an obstruction is present in the detection zone.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
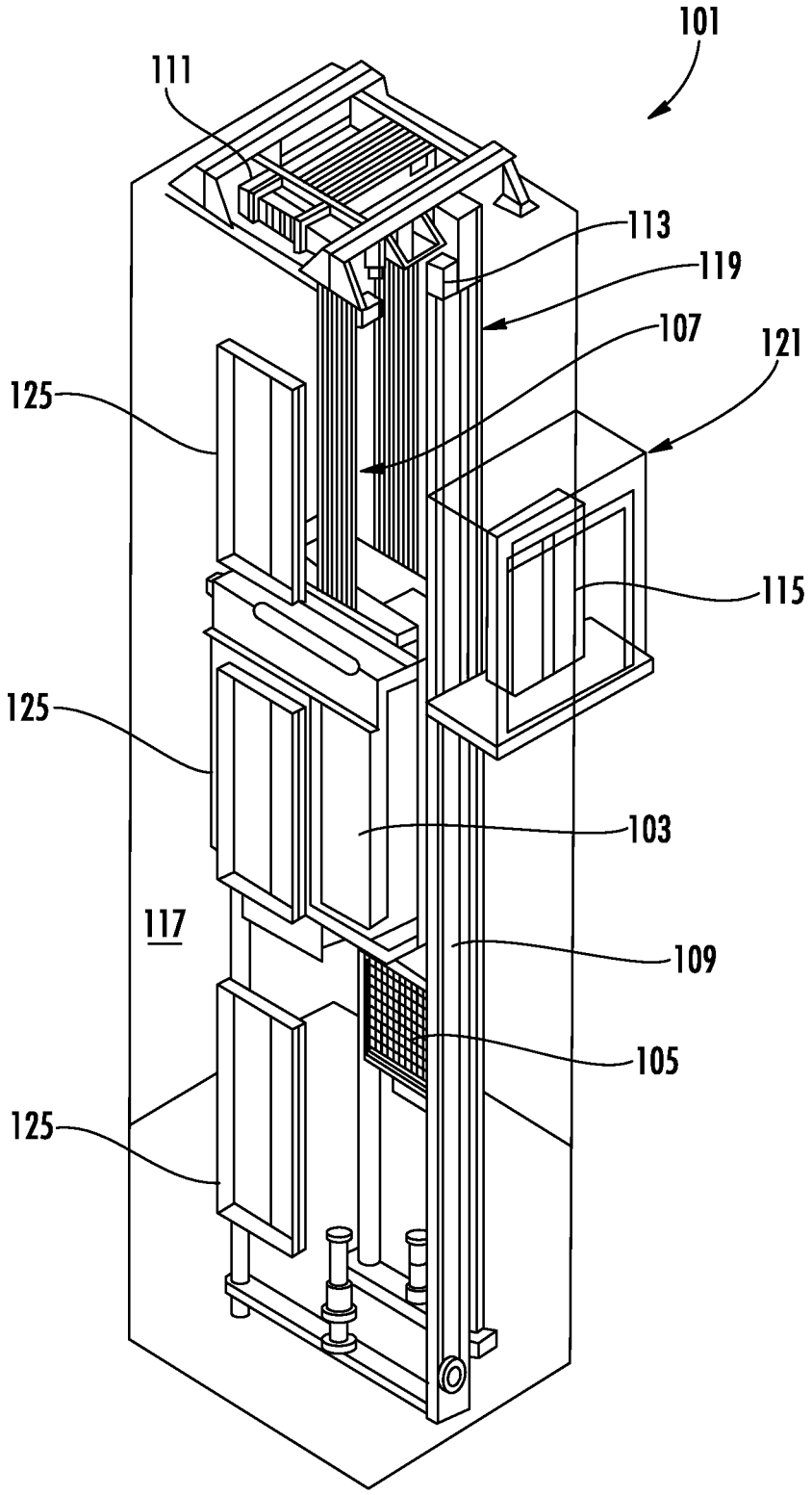
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
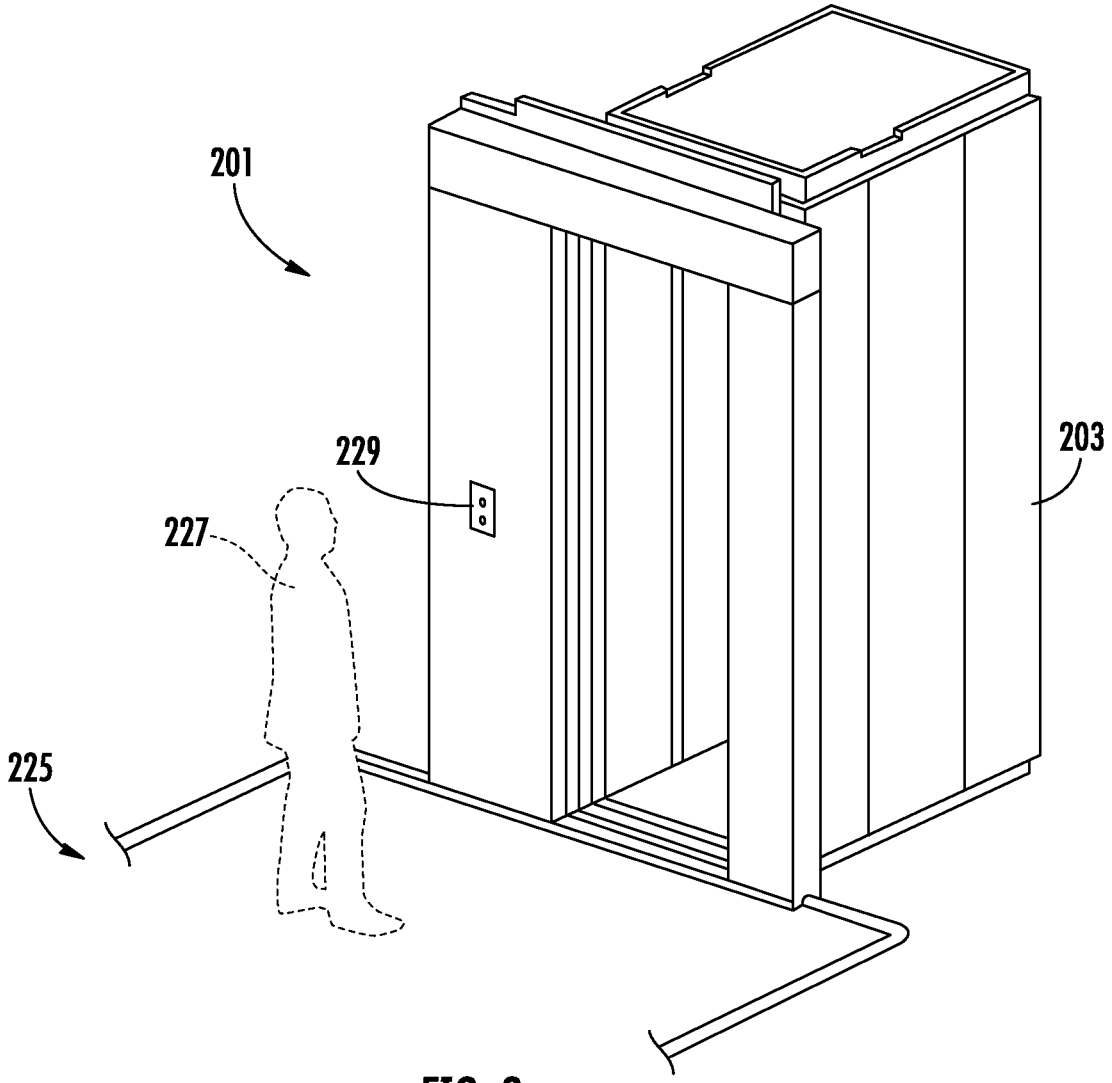
FIG. 2 is a schematic illustration of a landing floor of an elevator system with a hall call panel that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger 227 that desires to travel to another floor within a building using a hall call panel 229. When the elevator car 203 arrives at the landing 225 there may be passengers already in the elevator car that wish to exit from the elevator car 203. In certain situations or circumstances, it may be difficult for the passengers already in the elevator car 203 to see if there are passengers on the landing 225 (e.g., passenger 227 located on the landing 225 as shown in FIG. 2). For example, a wheelchair bound passenger may have entered the elevator car 203 in the forward facing direction, but once in the elevator car 203, the passenger cannot turn around and face outward toward the elevator car doors. As such, when the elevator car doors open at a landing, the back of the wheelchair bound passenger may be facing the landing, and the wheelchair bound passenger will not easily be able to recognize if there is someone or something blocking their exit from the elevator car 203. Accordingly, it may be advantageous to provide camera and display systems that enable passengers within an elevator car to readily identify if there is a person or object blocking the passenger from exiting the elevator car.

Further, prior solutions for such assistance involved the installation of mirrors at the corner where a sidewall/panel and the ceiling of the elevator car intersected. Such mirrors are typically curved (e.g., spherical mirror). However, in some elevator car configurations, the ceiling is openable and used as a platform or entranceway to access the top exterior of the elevator car, and thus enable maintenance within the elevator shaft. For example, maintenance performed from the top of the elevator car can include work on the machine and components in the elevator shaft that are located at the top of the elevator shaft. In such arrangements, the ceiling is opened from inside the elevator car and a ladder is deployed to allow the technician to climb onto the top exterior of the elevator car or onto a platform. As such, nothing can be fixed within the elevator car at locations that may prevent opening of a movable ceiling panel. Accordingly it may be advantageous to develop systems that enable assistance in visibility when in use while enabling in-car maintenance.

Figure 3A:
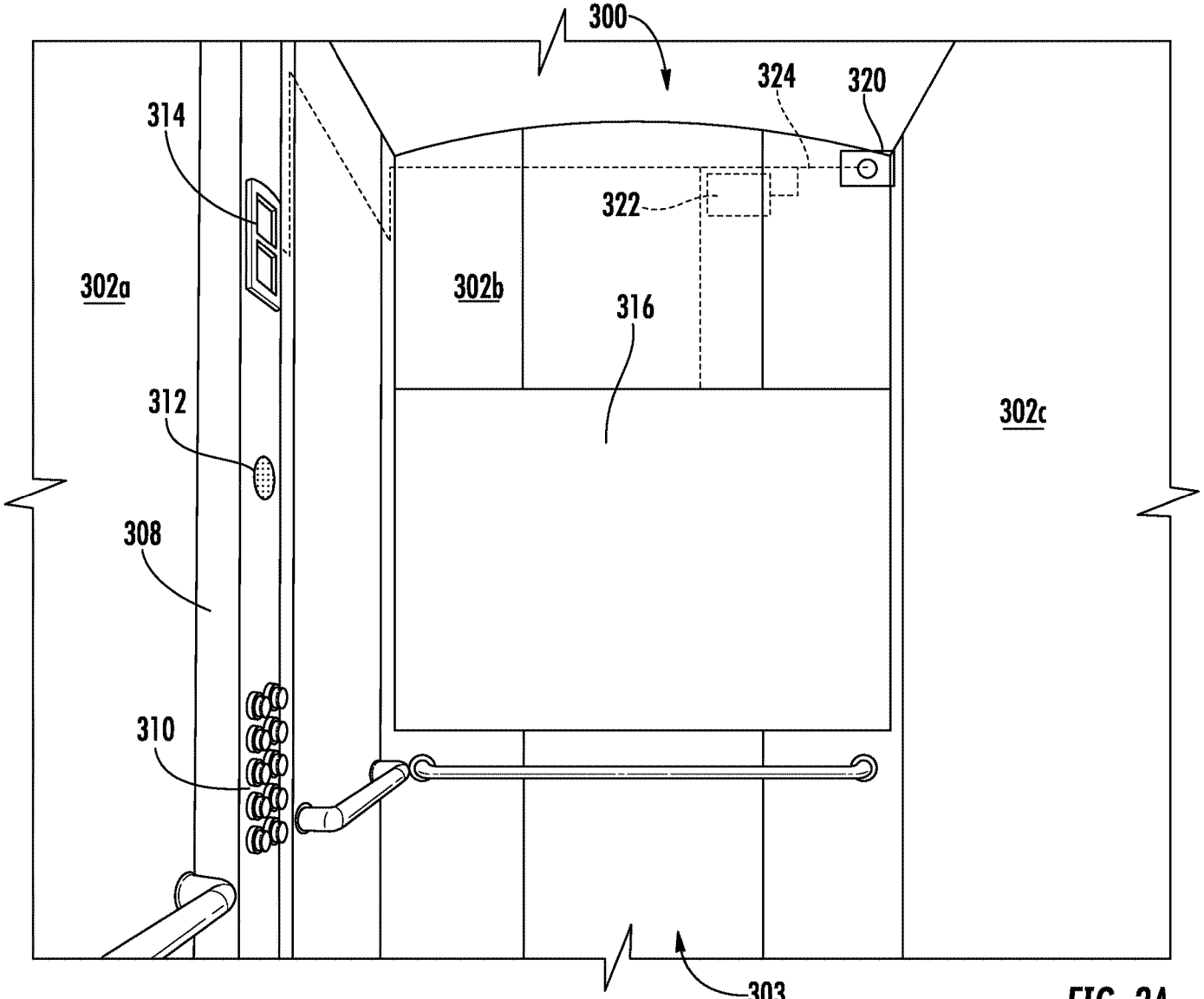
FIG. 3A is a schematic illustration of an interior of an elevator car incorporating an elevator doorway display system in accordance with an embodiment of the present disclosure as viewed from an elevator door position.
Figure 3B:
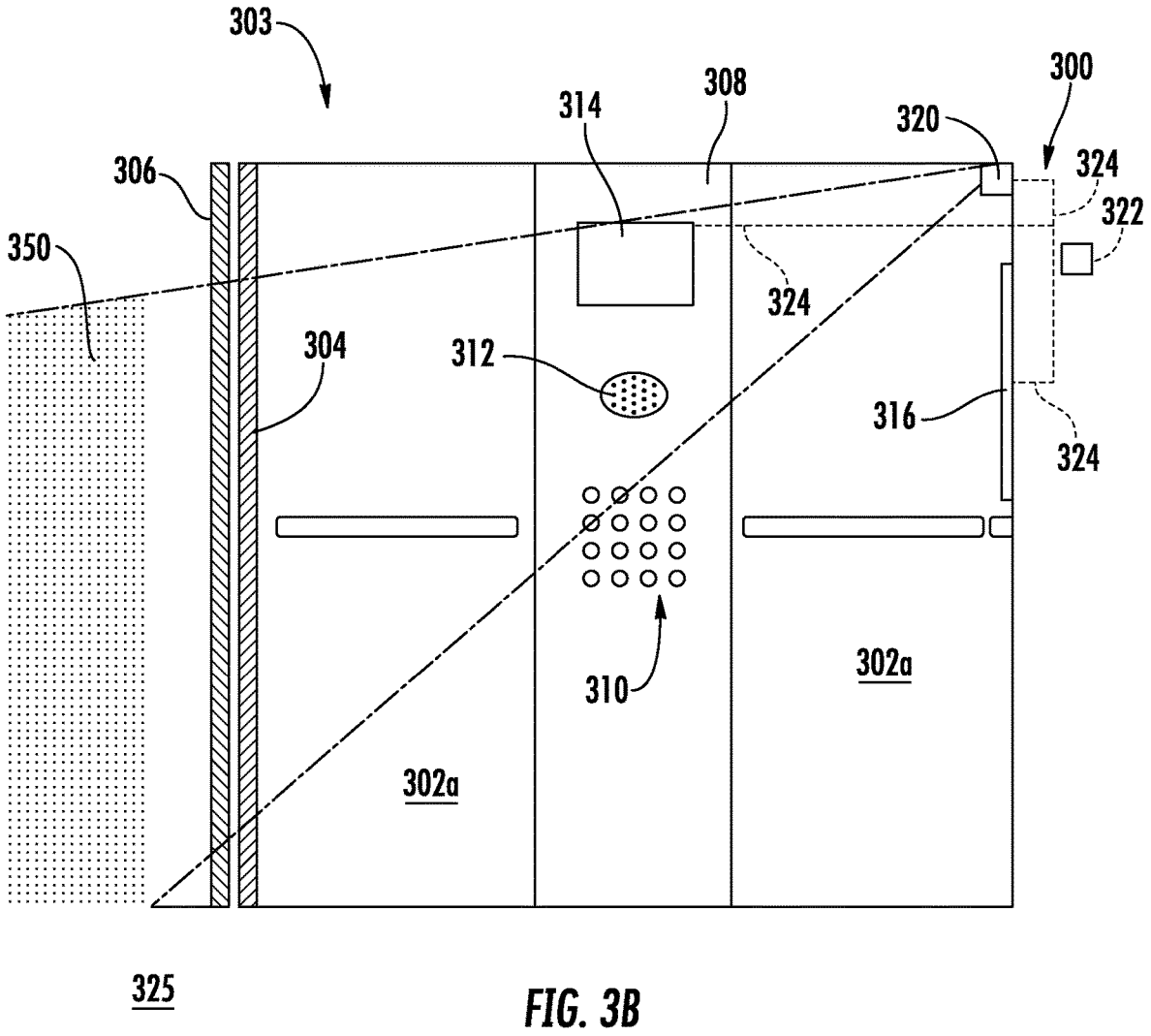
FIG. 3B is a side view schematic illustration of the elevator car and elevator doorway display system of FIG. 3A.

For example, turning now to FIGS. 3A-3B, schematic illustrations of an elevator doorway display system 300 in accordance with a non-limiting embodiment of the present disclosure are shown. The elevator doorway display system 300, as shown, is installed within an elevator car 303. FIG. 3A is a schematic view of the interior of the elevator car 303 as viewed from an elevator car door/landing door, and thus the elevator car door/landing door is not shown. FIG. 3B is a side view of the elevator car 303 at a landing 325.

The elevator car 303 includes wall panels 302*a*, 302*b*, 302*c* and an elevator car door 304. Although not shown, those of skill in the art will appreciate that a mirror, particularly a spherical mirror, can be installed and mounted at the top of one of the wall panels 302*a*, 302*b*, 302*c* or a corner between two of the wall panels 302*a*, 302*b*, 302*c*. The mirror enables a reflection of an opening of an elevator car door 304 at a landing 325 such that someone who is facing the second wall panel 302*b* can observe the opening of the doors.

When at the landing 325 (as shown in FIG. 3B), the elevator car door 304 aligns with a landing door 306 that enables access between the landing 325 and the elevator car 303. FIG. 3A is a schematic illustration of the interior of the elevator car 303 as viewed from the location of the landing door 306 and the elevator car door 304, as illustrated in FIG. 3B.

A first wall panel 302*a* of the elevator car 303, as shown, includes a car operating panel 308 including a control operating panel 310 (e.g., buttons), a speaker 312, and an operating panel display 314 (e.g., display screen). The control operating panel 310 is configured to enable passengers within the elevator car 303 to select destination floors, open/close elevator car doors 304, enter access codes, etc. to enable control of the elevator car 303. The speaker 312 can be used to provide audible notifications to passengers within the elevator car 303 (e.g., notification of the current floor). The operating panel display 314 can be used to provide a visual indication or notification to passengers within the elevator car 303, such as current floor, and/or can be used to display other information and/or images, including, but not limited to, weather, commercials, tenant information, etc.

As shown, a second wall panel 302*b* can be a wall panel that is opposite an elevator car door 304/landing door 306 (see FIG. 3B). A display 316 of the elevator doorway display system 300 can be mounted to and/or integrated into the second wall panel 302*b*. The display 316 can be a television, monitor, or other display screen positioned within the elevator car 303 to provide various information and/or entertainment within the elevator car 303. The display 316 is part of the elevator doorway display system 300 as described herein. Further, in some embodiments, the operating panel display can be part of the elevator doorway display system 300 and display similar images and/or information as displayed on the display 316.

The elevator doorway display system 300 of the currently described embodiment, and as shown in FIGS. 3A-3B, includes an imaging device 320. The imaging device 320 is arranged to capture image data (e.g., images and/or video) which can then be displayed on one or both of displays 314, 316 to aid passengers within the elevator car 303 and provide information about potentially obstructing persons and/or objects when exiting the elevator car 303. The image data obtained by the imaging device 320 can be direct-fed to the displays 314, 316 (e.g., live video image, live image capture) or may be processed as a detection means to enable display on the display(s) of a notification, icon, cartoon, etc. that provides information to a passenger that something (e.g., another passenger, object, etc.) is located within a detection zone 350, as described below.

In accordance with various embodiments, the imaging device 320 can be "always on" or triggered by opening and/or closing of the elevator car doors 304 and landing doors 306. The imaging device 320 can be a camera that can capture image data that can be processed into an image of the doorway when the elevator car doors 304 and landing doors 306 are opened and can capture live or real-time images (e.g., still image) or video to be displayed on the operating panel display 314 and/or the display 316 on the second wall panel 302*b*. The imaging device 320 can include a controller, processor, microprocessor, etc. that can enable control and processing as described herein. Alternatively or in combination therewith, a control unit 322 can be configured to receive signals, data, and/or information from the imaging device 320.

The displayed image/video (i.e., associated with image data obtained by the imaging device 320) can be displayed for a predetermined amount of time, and then cease being displayed. In some embodiments a timer can be used. In other embodiments, the display image can remain displayed as long as the elevator car doors remain open. Then, when the elevator car doors close or begin to close the image can cease being displayed.

As shown, the control unit 322, the imaging device 320, the operating panel display 314, and the display 316 are in communication over a communication network 324. The communication network 324, although shown as dashed lines and indicating wiring, can be configured as a wireless network, or a combination of wired and wireless communications. In some embodiments, the communication network 324 can enable the control unit 322 to operably control one or more of the imaging device 320, the operating panel display 314, and/or the display 316.

In operation, the elevator doorway display system 300 is configured to provide information to a passenger within the elevator car 303 regarding the environment of a landing 325 when the elevator car doors 304 open at the landing. For example, when the elevator car doors 304 open, the imaging device 320 can capture an image or video of the presence of a person or object that is obstructing an exit from the elevator car 303. As schematically shown in FIG. 3B, the imaging device 320 is configured to capture an image/video of a detection zone 350. The detection zone 350 can be a predetermined area, volume, distance, or range of distances from the imaging device 320 that is monitored by the imaging device 320. The detection zone 350 and/or location of the imaging device 320 can be preset or predetermined to optimize the elevator doorway display system 300 such that persons/objects within the elevator car 303 do not obstruct the captured image/video. In some embodiments, the detection zone 350 can be configured with other dimensions that include greater or lesser areas or volumes. For example, in some embodiments, the detection zone 350 can be configured to include a portion of the elevator car 303, e.g., proximate or immediately within the elevator car doors 304 of the elevator car 303. As such, for example, a person standing behind a wheelchair bound passenger can be viewed on one or more of the displays 314, 316. Thus, the detection zone 350 is not so limited to that shown and described in FIG. 3B, and those of skill in the art will appreciate that various configurations and settings for the detection zone 350 are possible without departing from the scope of the present disclosure.

In operation, the imaging device 320 will capture an image or video of the opening at the elevator car doors 304 and convey an image/video to one or both of the displays 314, 316 to be visually shown on the respective display(s). Accordingly, a passenger within the elevator car 303 that is facing one of the displays 314, 316 and cannot see or has difficulty seeing the opening of the elevator car doors 304 can be provided with information and/or images that provide the information that the passenger is lacking.

Figure 4A:
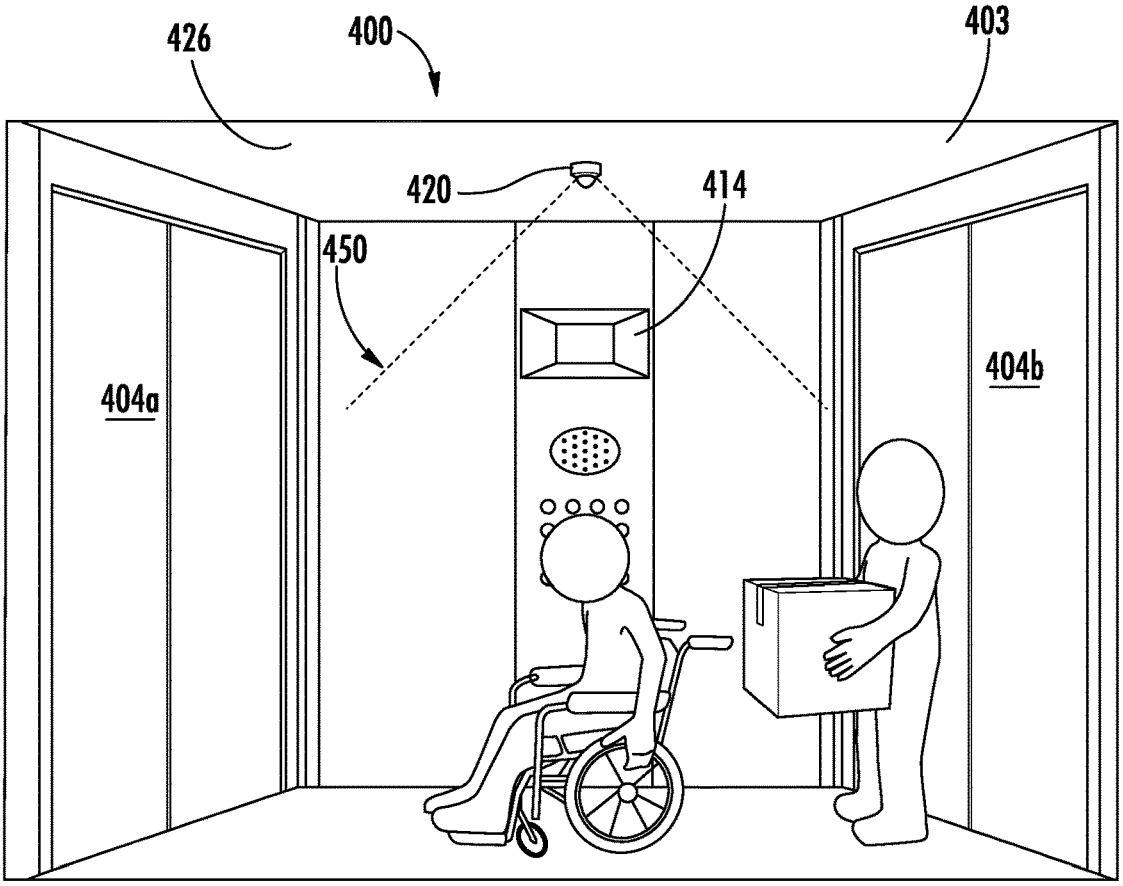
FIG. 4A is a side view schematic illustration of an interior of an elevator car incorporating an elevator doorway display system in accordance with another embodiment of the present disclosure.
Figure 4B:
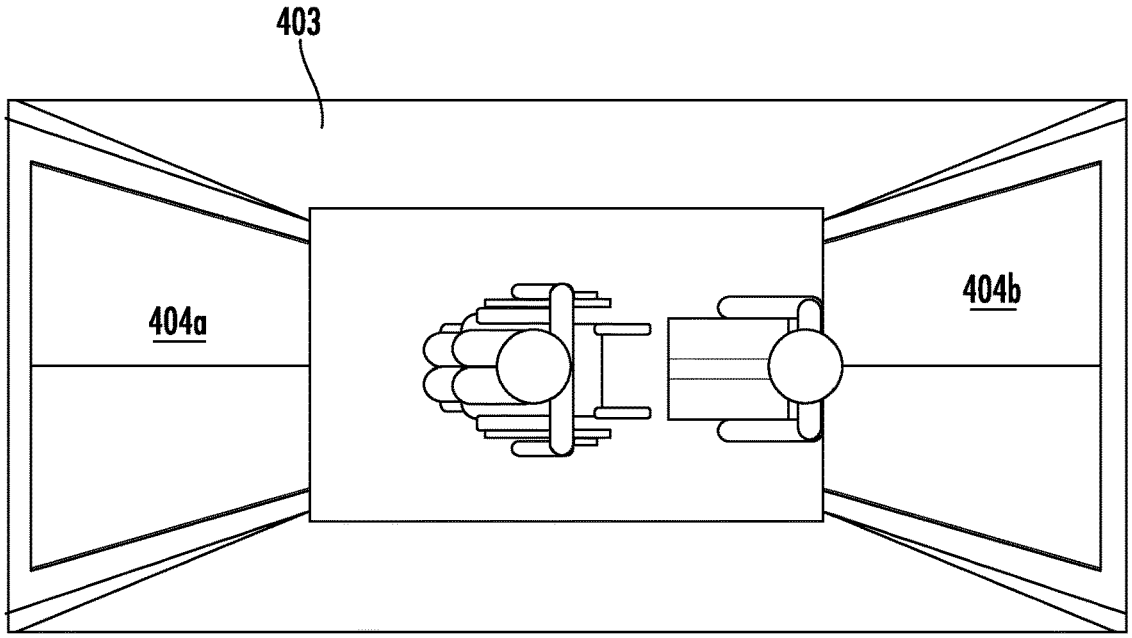
FIG. 4B is a schematic illustration of the interior of the elevator car as viewed from an imaging device of the present disclosure.

Turning to FIGS. 4A-4B, an alternative arrangement of an elevator doorway display system 400 in accordance with a non-limiting embodiment of the present disclosure is shown. FIG. 4A is a side view illustration of an elevator car 403 having a first elevator car door 404*a* and a second elevator car door 404*b*. In this embodiment, the elevator doorway display system 400 includes an imaging device 420 located on a ceiling 426 of the elevator car 403 that captures information within a detection zone 450. The detection zone 450 (and the imaging device 420) are arranged to provide a bird's eye view of the elevator car 403 as shown in FIG. 4B, which illustrates a view from the imaging device 420. Stated another way, FIG. 4B illustrates what is displayed on the display 414 for a passenger to view. As shown, the imaging device 420 captures images of both the first and second elevator car doors 404*a*, 404*b*. As such, a passenger within the elevator car 403 can view both elevator car doors 404*a*, 404*b* and openings thereof on a display 414, as shown.

As noted above, maintenance operations may require access to a top exterior of the elevator car, and an openable ceiling can provide a means for enabling this. With elevator doorway display systems as provided herein, such access while also enabling viewing assistance to passengers is enabled.

Figure 5A:
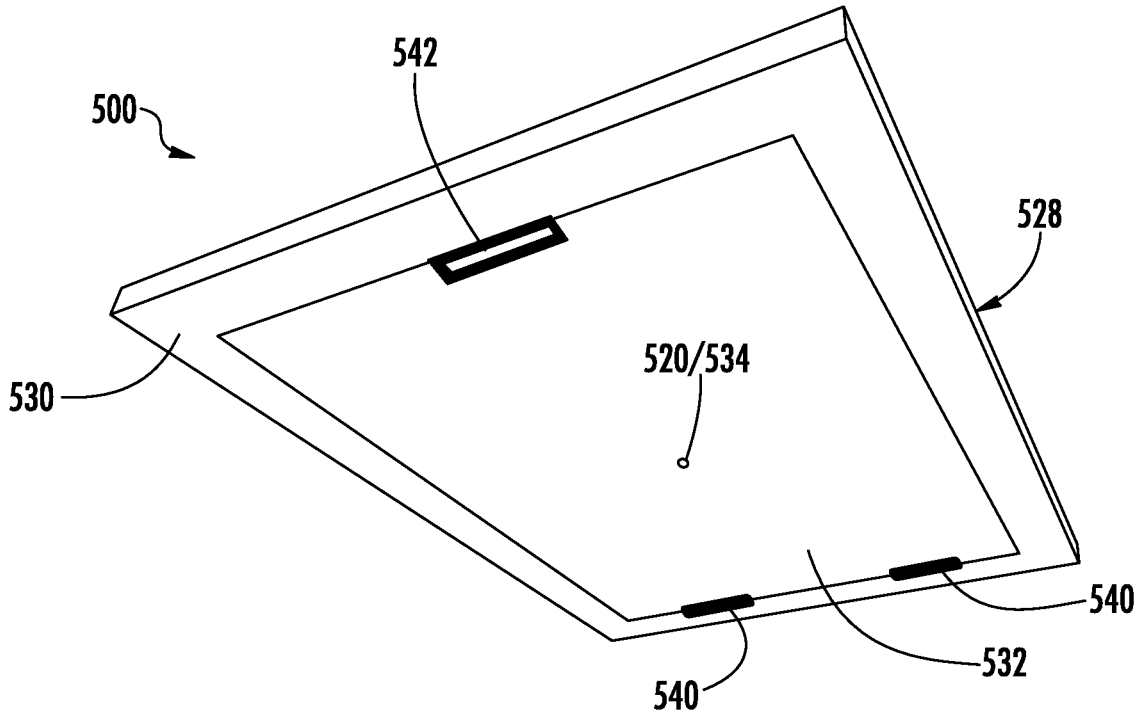
FIG. 5A is an isometric illustration from below an openable ceiling in accordance with an embodiment of the present disclosure.
Figure 5B:
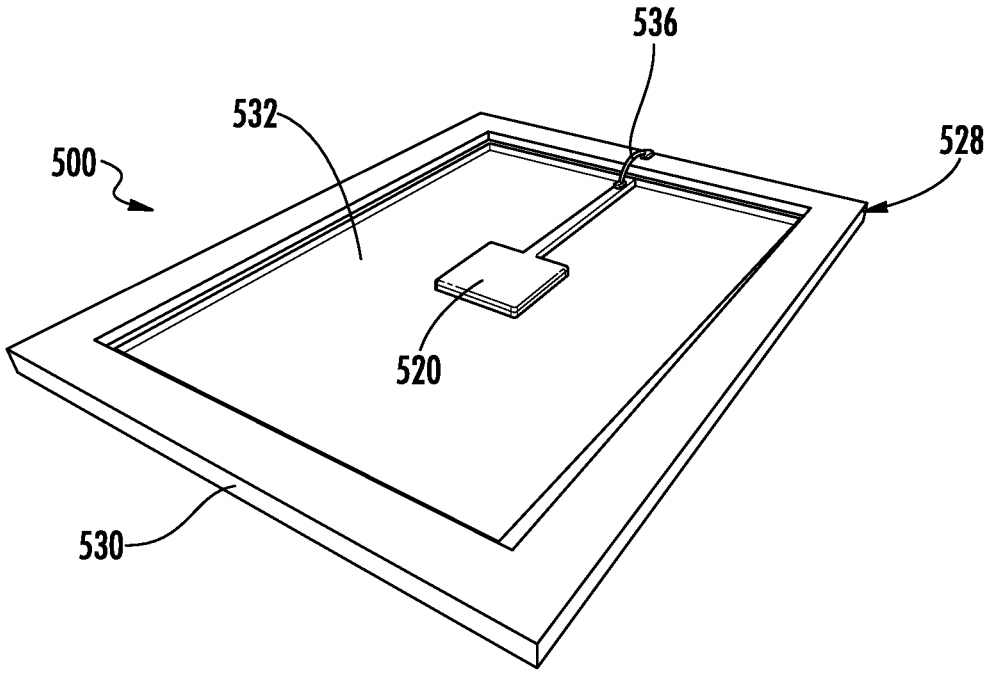
FIG. 5B is an isometric illustration from above the openable ceiling shown in FIG. 5A.
Figure 5C:
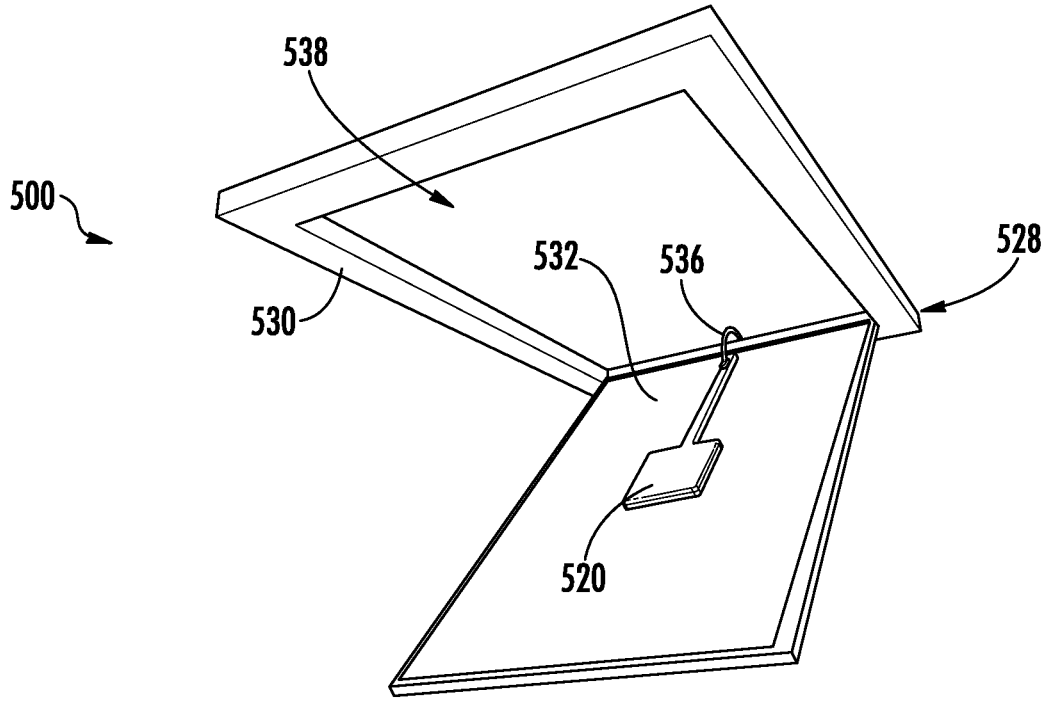
FIG. 5C illustrates the openable ceiling of FIG. 5A in an open position with an openable panel at a 45° angle.
Figure 5D:
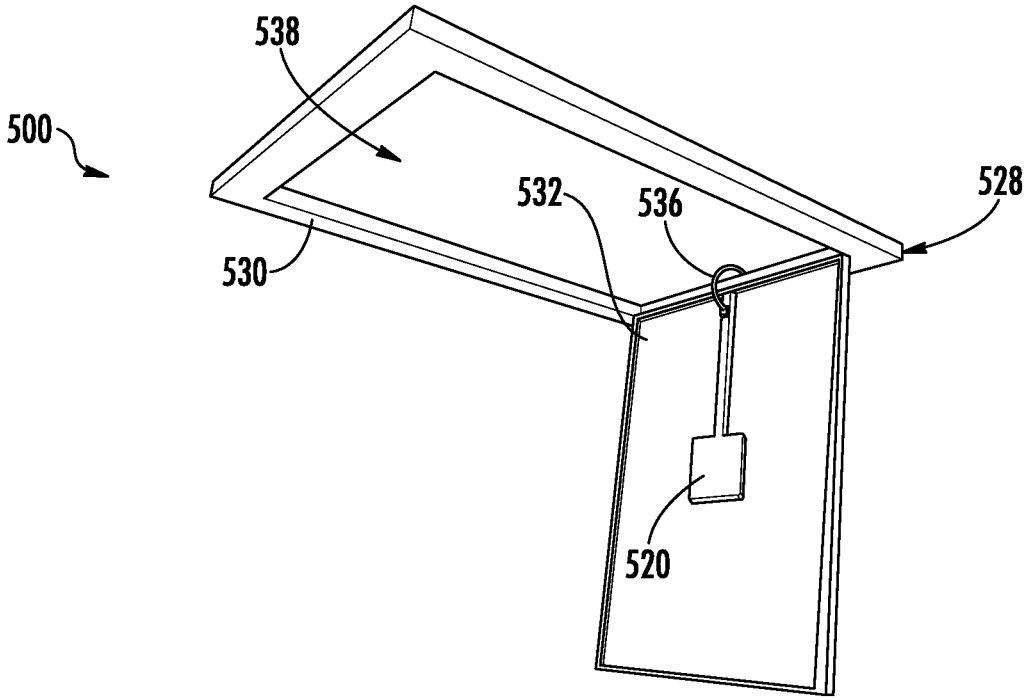
FIG. 5D illustrates the openable ceiling of FIG. 5A in an open position with an openable panel at a 90° angle.

For example, turning now to FIGS. 5A-5D, various views of an elevator doorway display system 500 in accordance with an embodiment of the present disclosure are shown. The elevator doorway display system 500 includes an openable ceiling 528 having a ceiling frame 530 and an openable panel 532. The openable ceiling 528 is part of an elevator car (not shown) such as shown and described above (e.g., elevator car doors on one or more sides of the elevator car). FIG. 5A is an isometric illustration from below the openable ceiling 528 (e.g., from within an elevator car), FIG. 5B is an isometric illustration from above the openable ceiling 528 (e.g., from the exterior of the elevator car looking downward at the top of the elevator car), FIG. 5C illustrates the openable ceiling 528 in an open position with the openable panel 532 at a 45° angle, and FIG. 5D illustrates the openable ceiling 528 in an open position with the openable panel 532 at a 90° angle. FIGS. 5A-5B illustrate the openable panel 532 in a closed state and FIGS. 5C-5D illustrate the openable panel 532 in an open state.

As shown in FIGS. 5A-5B, an imaging device 520 is mounted to the openable panel 532 and is arranged, in this embodiment, to view a passenger compartment of an elevator car through a viewing aperture 534. The viewing aperture 534 is formed in the openable panel 532 and is sized and shaped to allow an appropriate detection zone (e.g., as shown in FIGS. 4A-4B). In other embodiments, the imaging device can be a mounted camera that extends from the openable panel, such as that shown in FIG. 4A. Other installation and mounting arrangements are possible without departing from the scope of the present disclosure.

As shown in FIG. 5B, the elevator doorway display system 500 includes a flexible cable 536 to allow opening of the openable panel 532 without damaging wiring associated with the imaging device 520 and communication to a controller, control unit, display device, etc. The flexible cable 536 can be flexible wiring or may be a tubing or housing (e.g., hose) that has wiring passing therethrough. The wiring can be used to transmit image data (e.g., images, video, etc.) from the imaging device 520 to a display, as described above, or a processor to prompt an image to be displayed on the display.

The openable panel 532 of the openable ceiling 528 can be hinged to the ceiling frame 530 to enable pivoting or rotating opening, such as that illustrated in FIGS. 5C-5D. As shown, the openable panel 532 can swing downward (e.g., into the elevator car) to create an access way 538 for a mechanic or other person to gain access to a top of the elevator car.

Although shown in FIGS. 5A-5D with a wired configuration, in some alternative embodiments, a wireless arrangement is possible. In such arrangements, the imaging device may be battery powered, with the power used to operate the imaging device and process/transmit captured image data to a controller or display. In such embodiments, the flexible cable can be omitted.

Referring again to FIG. 5A, a non-limiting example of a mechanism for opening and operating the openable ceiling 528 is schematically shown. As shown, one or more pivot mechanisms 540 is arranged on the openable panel 532 and ceiling frame 530. The pivot mechanisms 540 can be hinges or other structure to enable opening and closing of the openable panel 532 relative to the ceiling frame 530. In some embodiments, the pivot mechanism(s) can be hidden from view from within the elevator car. For example, in some such embodiments, the pivot mechanism(s) in the form of hinges can be mounted on an external surface, e.g., exterior of the elevator car. In some embodiments, the pivot mechanism can be a rod or other element that extends across an end of the openable panel 532 and is supported by and rotatable relative to the ceiling frame 530. In some such embodiments, the rod or other element can be arranged internally to a portion of the openable panel 532. In some embodiments the pivot mechanism can be a biased element that urges the openable panel 532 toward the closed position, and a mechanic can use a lock or securing means to hold the openable panel 532 in an open position.

Also shown in FIG. 5A, the openable panel 532 includes an optional handle 542. The handle 542 can include a locking or latching mechanism to secure the openable panel 532 in the closed position. In some embodiments, the handle 542 can include a lock or keyway such that the openable panel 532 can be locked in the closed position. The handle 542 can enable manual opening and closing of the openable panel 532. In some alternative embodiments, the end of the openable panel 532 with the handle 542 can omit the handle 542 and rather be mounted or removable fixed to the ceiling frame 530 by one or more fasteners (e.g., screws, bolts, pin-keyway mechanisms, etc.).

Various embodiments of the present disclosure are directed to installing a video camera or other imaging device in the center (or other location) of a ceiling of a passenger compartment in an elevator car in order to film the inside of the elevator car. In some embodiments, an operating panel display can be used to display what the camera sees when the elevator car reaches a landing (and the doors will open). In some embodiment, when the elevator is in motion (e.g., traveling between landings), the displayed image/video can disappear from the screen to make room for other display information (e.g., direction of travel, current landing, weather, etc.). In some embodiments, a second screen or display can be installed in the car operating panel and permanently display what the display device captures. Advantageously, passengers in wheelchairs or otherwise impaired from movement (e.g., carrying packages, children, etc.) can see if there is someone/something behind them when they want to exit the elevator car.

Although shown and described with respect to a limited number of illustrative embodiments, the present disclosure is not to be limited thereby. For example, although shown and described as capturing a live image, such live image need not be displayed on the display. Instead a notification, cartoon, or other indicator that an obstruction is present in the detection zone can be displayed on the display, without having to record or otherwise capture an image of a person that is within the detection zone.

Further, although shown with the display mounted to a wall panel of the elevator car, the display is not so limited.

For example, a display that is part of the car operating panel can be used to display an image or information regarding an object or person within the detection zone. In other embodiments, a display can be mounted in other locations within the elevator car, such as mounted in an upper corner of the elevator car. Further, as noted above, the location of the imaging device are not limited to those locations shown and described. For example, in some embodiments, the imaging device can be located on a ceiling proximate the elevator car door(s).

Further, in some non-limiting embodiments, the imaging device can be located on the landing and the display within the elevator car can be in communication therewith. In such an example, each landing within a building may have a specific imaging device that is in communication with a control unit of the elevator car, and then when the elevator car arrives at a particular landing, the opening of the landing doors can be used to activate the system similar to that described above.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car having a first elevator car door and an openable ceiling and defining a passenger space, the openable ceiling comprising a ceiling frame and an openable panel, the openable panel moveable from an open position to a closed position relative to the ceiling frame;

an imaging device mounted to the openable panel and configured to capture image data of a detection zone that includes at least a portion of the passenger space and an opening formed by the first elevator car door when the openable panel is in the closed position; and a display located within the elevator car to display an image associated with the image data received from the imaging device, wherein the openable panel is openable to create an access way that permits access from an interior of the elevator car to a top exterior of the elevator car, wherein the openable panel includes a viewing aperture that is sized and shaped to allow the detection zone to be viewed by the imaging device therethrough, wherein the imaging device is arranged on a side of the openable panel opposite from the passenger space when the openable panel is in the closed position and the imaging device is aligned with the viewing aperture to image the detection zone.

2. The elevator system of claim 1, wherein the imaging device is operably connected to the display by wiring.

3. The elevator system of claim 2, wherein the wiring is housed within a flexible cable that enables movement of the imaging device when the openable panel is moved from the closed position to the open position.

4. The elevator system of claim 1, wherein the openable ceiling further comprises a pivot mechanism, the openable panel pivotable about the pivot mechanism relative to the ceiling frame.

5. The elevator system of claim 4, wherein the pivot mechanism is arranged internally to a portion of the openable panel.

6. The elevator system of claim 1, wherein the openable panel includes a handle.

7. The elevator system of any claim 6, wherein the handle includes a latching mechanism arranged to releasably secure the openable panel in the closed position.

8. The elevator system of claim 1, wherein:

the elevator car includes a second elevator car door; and the detection zone includes at least an opening formed by the second elevator car door when the openable panel is in the closed position.

9. The elevator system of claim 1, wherein the imaging device is a mounted camera that extends from the openable panel.

10. The elevator system of claim 1, wherein the image data is live video image of the detection zone.

11. The elevator system of claim 1, wherein the image data is captured only when the elevator car door is open.

12. The elevator system of claim 1, wherein the displayed image associated with the image data comprises one of a live video, a still image, a notification, a cartoon, or an indicator that an obstruction is present in the detection zone.

13. An elevator system comprising:

an elevator car having a first elevator car door and an openable ceiling and defining a passenger space, the openable ceiling comprising a ceiling frame and an openable panel, the openable panel moveable from an open position to a closed position relative to the ceiling frame;

an imaging device mounted to the openable panel and configured to capture image data of a detection zone that includes at least a portion of the passenger space and an opening formed by the first elevator car door when the openable panel is in the closed position; and a display located within the elevator car to display an image associated with the image data received from the imaging device, wherein the openable panel is openable to create an access way that permits access from an interior of the elevator car to a top exterior of the elevator car, wherein the openable ceiling further comprises a pivot mechanism, the openable panel pivotable about the pivot mechanism relative to the ceiling frame.

14. The elevator system of claim 13, wherein the imaging device is operably connected to the display by wiring.

15. The elevator system of claim 14, wherein the wiring is housed within a flexible cable that enables movement of the imaging device when the openable panel is moved from the closed position to the open position.

16. The elevator system of claim 13, wherein the pivot mechanism is arranged internally to a portion of the openable panel.

17. The elevator system of claim 13, wherein the openable panel includes a handle.

18. The elevator system of any claim 17, wherein the handle includes a latching mechanism arranged to releasably secure the openable panel in the closed position.

19. The elevator system of claim 13, wherein:

the elevator car includes a second elevator car door; and the detection zone includes at least an opening formed by the second elevator car door when the openable panel is in the closed position.

20. The elevator system of claim 13, wherein the displayed image associated with the image data comprises one of a live video, a still image, a notification, a cartoon, or an indicator that an obstruction is present in the detection zone.

* * * * *